US011549290B2

(12) United States Patent
Hsu et al.

(10) Patent No.: US 11,549,290 B2
(45) Date of Patent: Jan. 10, 2023

(54) LOCKING ASSEMBLY WITH TRIGGER HANDLE

(71) Applicant: Spectrum Brands, Inc., Middleton, WI (US)

(72) Inventors: Wei Hsu, Lake Forest, CA (US); Andy Chen, Xiamen (CN); Oscar Romero, Lake Forest, CA (US)

(73) Assignee: Spectrum Brands, Inc., Middleton, WI (US)

( * ) Notice: Subject to any disclaimer, the term of this patent is extended or adjusted under 35 U.S.C. 154(b) by 113 days.

(21) Appl. No.: 16/998,805

(22) Filed: Aug. 20, 2020

(65) Prior Publication Data

US 2022/0056735 A1 Feb. 24, 2022

Related U.S. Application Data

(60) Provisional application No. 62/891,026, filed on Aug. 23, 2019.

(51) Int. Cl.
*E05C 1/14* (2006.01)
*E05B 55/12* (2006.01)
(Continued)

(52) U.S. Cl.
CPC ..... *E05C 1/14* (2013.01); *E05B 1/0015* (2013.01); *E05B 1/0053* (2013.01); *E05B 3/06* (2013.01);
(Continued)

(58) Field of Classification Search
CPC ..... E05B 1/0015; E05B 1/0053; E05B 3/06; E05B 13/105; E05B 15/04;
(Continued)

(56) References Cited

U.S. PATENT DOCUMENTS 1,059,952 A * 4/1913 Spooner ..... E05B 85/16 292/226
1,964,066 A * 6/1934 Kuszmaul ..... E05B 85/22 292/172
(Continued)

FOREIGN PATENT DOCUMENTS

FR 1115330 A 4/1956
FR 67612 E 3/1958
WO 9607003 A1 3/1996

OTHER PUBLICATIONS

International Search Report and Written Opinion for PCT/US2020/047039, dated Nov. 27, 2020.
(Continued)

*Primary Examiner* — Christopher J Boswell
(74) *Attorney, Agent, or Firm* — Merchant & Gould P.C.

(57) ABSTRACT

A latching handleset assembly includes a handle, a trigger, and a latch driver. The handle has a handle portion and a top mounting portion that extends from an escutcheon. The top mounting portion has a top surface and a bottom that is at least partially obscured by the handle portion. The trigger includes an exterior end located along the bottom of the top mounting portion and an interior end extending into the escutcheon. The trigger is pivotable about a pivot point positioned within the escutcheon. The latch driver is movable between a neutral position and a latch actuating position in response to actuation of the trigger.

20 Claims, 11 Drawing Sheets

(51) Int. Cl.

| | |
|---|---|
| ***E05B 1/00*** | (2006.01) |
| ***E05B 13/10*** | (2006.01) |
| ***E05B 3/06*** | (2006.01) |
| ***E05B 15/04*** | (2006.01) |
| ***E05B 55/00*** | (2006.01) |
| ***E05C 1/12*** | (2006.01) |
| ***E05C 3/16*** | (2006.01) |

(52) U.S. Cl.
CPC ..... *E05B 13/105* (2013.01); *E05B 15/04* (2013.01); *E05B 55/005* (2013.01); *E05B 55/12* (2013.01); *E05C 1/12* (2013.01); *E05C 3/16* (2013.01); *E05B 2015/0413* (2013.01); *E05Y 2201/716* (2013.01); *E05Y 2201/722* (2013.01)

(58) Field of Classification Search
CPC ..... E05B 2015/0413; E05B 17/2034; E05B 17/2042; E05B 55/005; E05B 55/12; E05B 57/00; E05B 63/22; E05C 1/12; E05C 1/14; E05C 1/16; E05C 3/12; E05C 3/16; E05C 3/182; E05C 3/165
See application file for complete search history.

(56) References Cited

U.S. PATENT DOCUMENTS 2,321,724 A * 6/1943 Aldeen ..... E05C 1/14 292/336.3
2,475,880 A * 7/1949 Conlon ..... E05C 1/14 292/170
2,825,596 A * 3/1958 Nagy ..... E05B 1/0053 292/336.3
3,101,965 A * 8/1963 Muttart ..... E05B 55/005 292/357
3,287,054 A * 11/1966 Russell ..... E05C 3/12 292/336.3
4,052,092 A * 10/1977 Bergen ..... E05C 1/14 70/462
4,725,085 A * 2/1988 Hu ..... E05B 55/00 292/1.5
4,732,417 A * 3/1988 Yang ..... E05C 1/14 292/336.3
5,123,683 A 6/1992 Solovieff
5,700,044 A * 12/1997 Wartian ..... E05C 3/162 292/336.3
5,826,924 A * 10/1998 Huang ..... E05B 13/004 70/483
6,328,357 B1 * 12/2001 Overbey ..... E05B 1/003 292/172
7,309,087 B2 * 12/2007 Lane ..... E05B 85/247 292/216
8,302,437 B2 * 11/2012 Fang ..... E05B 65/1086 70/91
2010/0257905 A1 10/2010 Tsai

OTHER PUBLICATIONS

Trapp Storm Door Repair "Wartian Oil Rubbed Bronze PH-8000 Trigger Handle Set", "Wartian Satin Nickel PH-8000 Trigger Handle Set", obtained May 16, 2019 from www.dlydoorstore.com/trapp-storm-door-trigger-handles.html.

* cited by examiner

LOCKING ASSEMBLY WITH TRIGGER HANDLE

CROSS REFERENCE TO RELATED APPLICATION

This application claims the benefit of U.S. Provisional Application Ser. No. 62/891,026, filed Aug. 23, 2019, the disclosure of which is hereby incorporated by reference in its entirety.

TECHNICAL FIELD

This invention relates to the field of door handlesets and door locks. More particularly, this invention relates to a trigger-containing handle of a lock assembly.

BACKGROUND

Door handlesets and locks are commonly installed in residential and commercial settings. The handlesets include a latch assembly that is actuatable by a mechanism. Latch assemblies are used for maintaining a door in a closed position using a bolt that moves between extended and retracted positions. In existing latches, the bolt is actively pulled between the extended and retracted positions. This pulling of the bolt is often the result of turning a door knob or a latch of the handleset. In the existing latches, the latches are spring-latches, which means that the latch is spring loaded all the time, and the latch is only retracted when the user operates the knob or the thumbpiece mounted on the face of the handleset.

The pushing and pulling of the bolt may also be accomplished by the actuation of a trigger. Some triggers require actuation with the thumb and require significant push force. The thumbpieces are also a separate piece located above the handle of the handlesets, which is visually unappealing.

SUMMARY

In general terms, this disclosure is directed towards a latching assembly for use on internal and external doors. This disclosure relates generally to a handleset with or without a traditional locking cylinder. The latching handleset assembly includes an internal spring-actuated mechanism.

In a first aspect, a latching handleset assembly is described. The latching handleset assembly includes a handle, a trigger, and a latch driver. The handle has a handle portion and a top mounting portion that extends from an escutcheon. The top mounting portion has a top surface and a bottom that is at least partially obscured by the handle portion. The trigger includes an exterior end located along the bottom of the top mounting portion and an interior end that extends into the escutcheon. The trigger is pivotable about a pivot point positioned within the escutcheon. The latch driver is movable between a neutral position and a latch actuating position in response to actuation of the trigger.

In another embodiment, a method for operating a latching handleset assembly is described. The method includes the following: in response to actuation of an exterior end of a trigger, the trigger pivots about the pivot point positioned within an escutcheon, and pivoting the trigger causes an interior end of the trigger located within the escutcheon to actuate a latch driver, and actuating the latch driver causes the latch driver to move between a neutral position and a latch actuating position.

In yet another aspect, a latching handleset assembly for use on a door is described. The latching handleset assembly includes a handle, a trigger, a latch driver, and a latch assembly. The handle has a vertical handle portion and a top mounting portion that extends in a horizontal direction away from an escutcheon mounted on the door. The top mounting portion has a top surface and a bottom that is at least partially obscured by the handle portion. The trigger includes an exterior end located along the bottom of the top mounting portion and an interior end extending into the escutcheon. The trigger is pivotable about a pivot point positioned within the escutcheon. The latch driver is movable between a neutral position and a latch actuating position in response to actuation of the trigger. The latch assembly includes a bolt movable between an extended position and a retracted position in response to actuation of the trigger.

Corresponding reference characters indicate corresponding parts throughout the several views. The exemplifications set out herein illustrate an embodiment of the invention, and such exemplifications are not to be construed as limiting the scope of the invention in any manner.

BRIEF DESCRIPTION OF THE DRAWINGS

The present disclosure will be described hereafter with reference to the attached drawings which are given as non-limiting examples only, in which.

DETAILED DESCRIPTION

Figure 1:
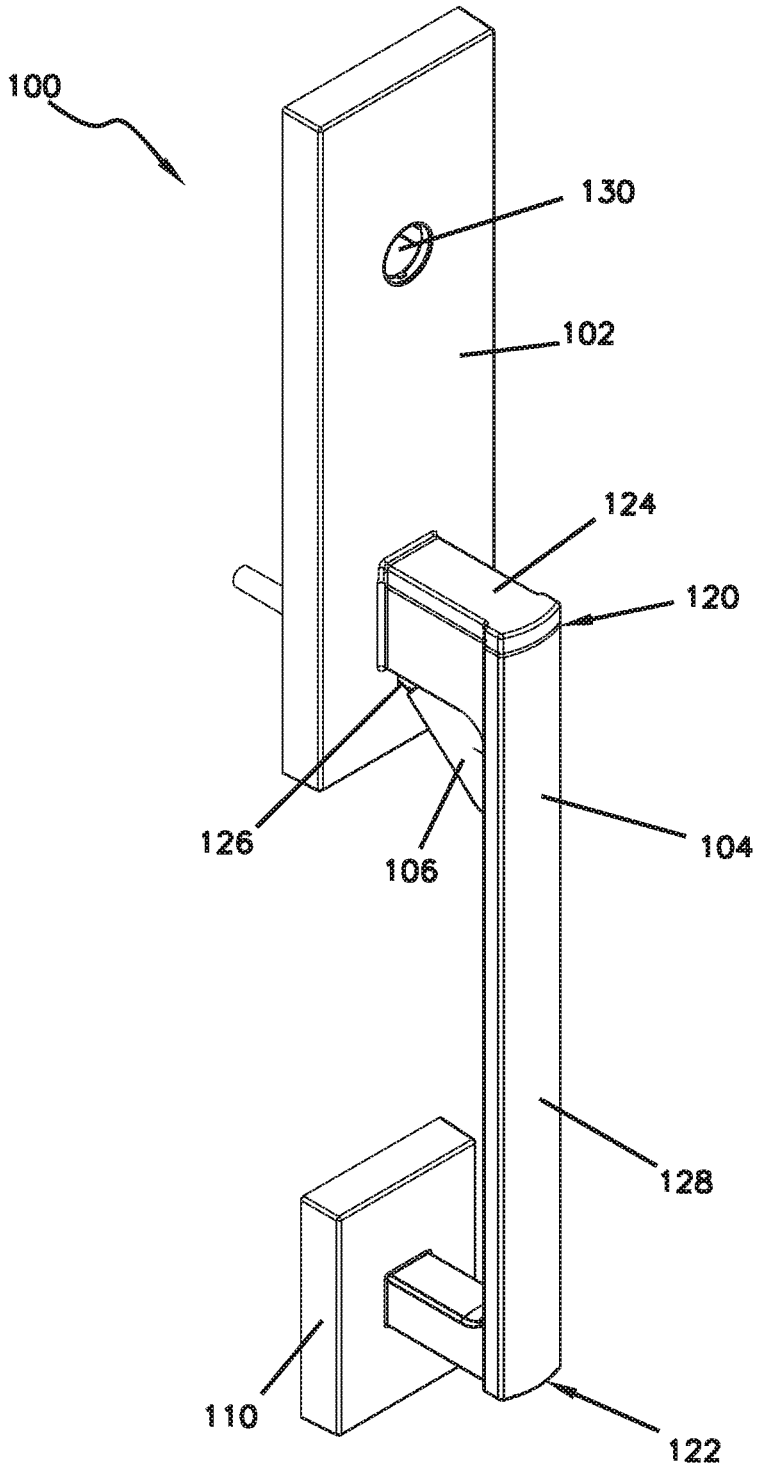
FIG. 1 shows a perspective view of an exterior portion of a locking assembly in accordance with the present disclosure.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

This disclosure relates generally to a handleset with a trigger to actuate a latch assembly to open a door. The handle includes a trigger that is at least partially obscured by a handle portion. Unlike other trigger-actuated handlesets, the trigger as described herein is aesthetically pleasing, easy to use, and secure. Upon actuation of the trigger, a latch driver moves from a neutral position to a latch actuating position, which allows a user to open the door.

It is noted that certain existing devices attempt to create more visually appealing handlesets by positioning the actuating mechanism within the handle. However, these actuating mechanisms have significant disadvantages. For example, the pivot point of the actuating mechanism may be located outside the escutcheon (e.g., on a portion of the handle) and is therefore breakable and less secure. The pivot points of the actuating mechanisms are also generally located in a direction normal to the door and are in the way if the door handle is to be used without requiring actuation of the trigger. Still further, positioning of a trigger on the handle itself requires a significantly more complex linkage to the bolt that is actuated. By way of contrast, the trigger-actuated handleset described herein requires only a simple linkage that is similar to thumb-actuated handleset mechanisms. That results in a handleset which has known security features while improving overall user operation.

FIG. 1 illustrates a latching handleset assembly 100 according to one embodiment of this disclosure. The latching handleset assembly 100 includes at least an escutcheon 102, a handle 104, and a trigger 106. In the example shown, the latching handleset assembly 100 may also include a second escutcheon 110; however, the second escutcheon 110 is not required.

The handle 104 includes a top mounting portion 120 having a top surface 124 and a bottom 126. A handle portion 128 extends from the top mounting portion 120 in a generally perpendicular direction. The handle portion 128 partially obscures at least part of the bottom 126 of the top mounting portion 120. In an example, the handle 104 also includes a bottom mounting portion 122. The handle 104 may also include a bottom mounting portion 122 that is connected to the handle portion 128, at an end opposing the top mounting portion 120.

The escutcheon 102 covers the internal mechanisms of the handleset assembly when installed on a door, and also provides an aesthetically pleasing surface. As shown, the escutcheon 102 has a decorative rectangular shape, but round, square, and other shapes for the escutcheon 102 are within the scope of the disclosure. Further, a second escutcheon 110 may also be included in the latching handleset assembly 100. The bottom mounting portion 122 extends from the second escutcheon 110. The escutcheon 102 may be formed from metal or plastic depending on the circumstances.

In some embodiments, the escutcheon 102 may also include a locking cylinder 130. The locking cylinder 130 is configured to accept a key or other unlocking mechanism. A mechanical key (not shown) may be inserted into the locking cylinder 130 to mechanically unlock the latching handleset assembly 100.

In an example embodiment where the latching handleset assembly 100 is mounted to an outside of a door (not shown), the locking cylinder 130 is in communication with a locking assembly (not shown). Example locking assemblies include a deadbolt or a bolt requiring a key, or other similar types of locking mechanisms. In an embodiment where the latching handleset assembly 100 is mounted to an inside of the door, the latching handleset assembly 100 may not include a locking cylinder 130.

In another alternative example, the escutcheon 102 may include an electronic locking assembly (not shown) useful for receiving an unlock command. The electronic locking assembly may include a keypad. In use, a user enters a predetermined passcode at the keypad, which functions to unlock the door. In an alternative embodiment, a biometric sensor is used instead of a keypad. For example, a resident of a home may have a fingerprint stored within the biometric control system. The user moves a finger across the sensor, and the sensor transmits the sensed fingerprint to a control circuit. The control circuit compares the sensed fingerprint to a stored fingerprint, and may allow access into the building if the sensed fingerprint matches the stored fingerprint. In yet another embodiment, a keypad is not present. A user may use an RFID tag that allows a motor to actuate when the correct RFID tag is detected.

Figure 2:
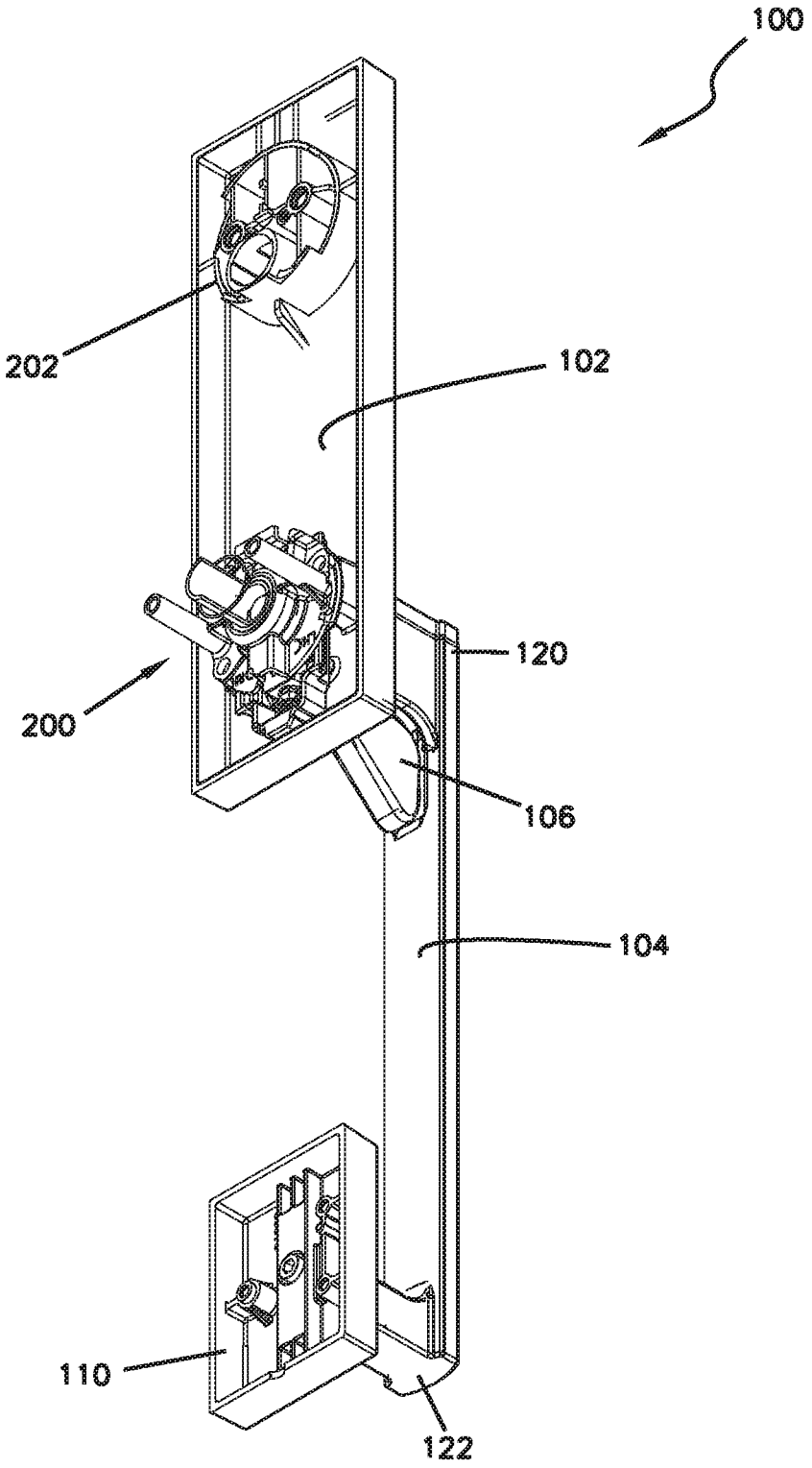
FIG. 2 shows a perspective view of an interior portion of the locking assembly of FIG. 1.

FIG. 2 illustrates the interior of the latching handleset assembly 100. The interior of the escutcheon 102 includes a housing that defines a recessed area for internal components, such as a housing assembly 200. The interior of the escutcheon 102 also includes attachment mechanisms (not shown) for connecting the top mounting portion 120 to the escutcheon 102. The interior of the second escutcheon 110 also includes a housing that defines a recessed area for internal components, such as attachment mechanisms (not shown) for connecting the bottom mounting portion 122 to the second escutcheon 110.

The housing assembly 200 is configured to connect to and communicate with a latch assembly (not shown). The latch assembly includes a latch bolt movable between a retracted position and an extended position. The latch assembly is disposed in a bore hole in the door (not shown) and may be actuated manually by the trigger 106. The trigger 106 is capable of extending and retracting the latch bolt.

The latch bolt moves linearly in and out of a barrel between a retracted position and an extended position. When the latch bolt is retracted, an end of the latch bolt is generally flush with a strike plate and a bore in the door. When the latch bolt is extended, the latch bolt protrudes through an edge bore in the door into an opening of a strike plate (not shown), which is positioned in a jamb adjacent the door. As is typical, the strike plate is attached to the jamb using fasteners. The term "interior" is broadly used to denote an area inside or within a door and "exterior" is broadly used to mean an area outside a door. Additionally, a retracted position is broadly used to denote an "unlatched" position and an extended position is broadly used to denote a "latched" position.

In an embodiment, the interior of the escutcheon 102 also includes a deadbolt mechanism 202, such as an internal deadbolt (not shown). The deadbolt mechanism 202 is in communication with the locking cylinder 130 to provide a locking means.

Figure 3:
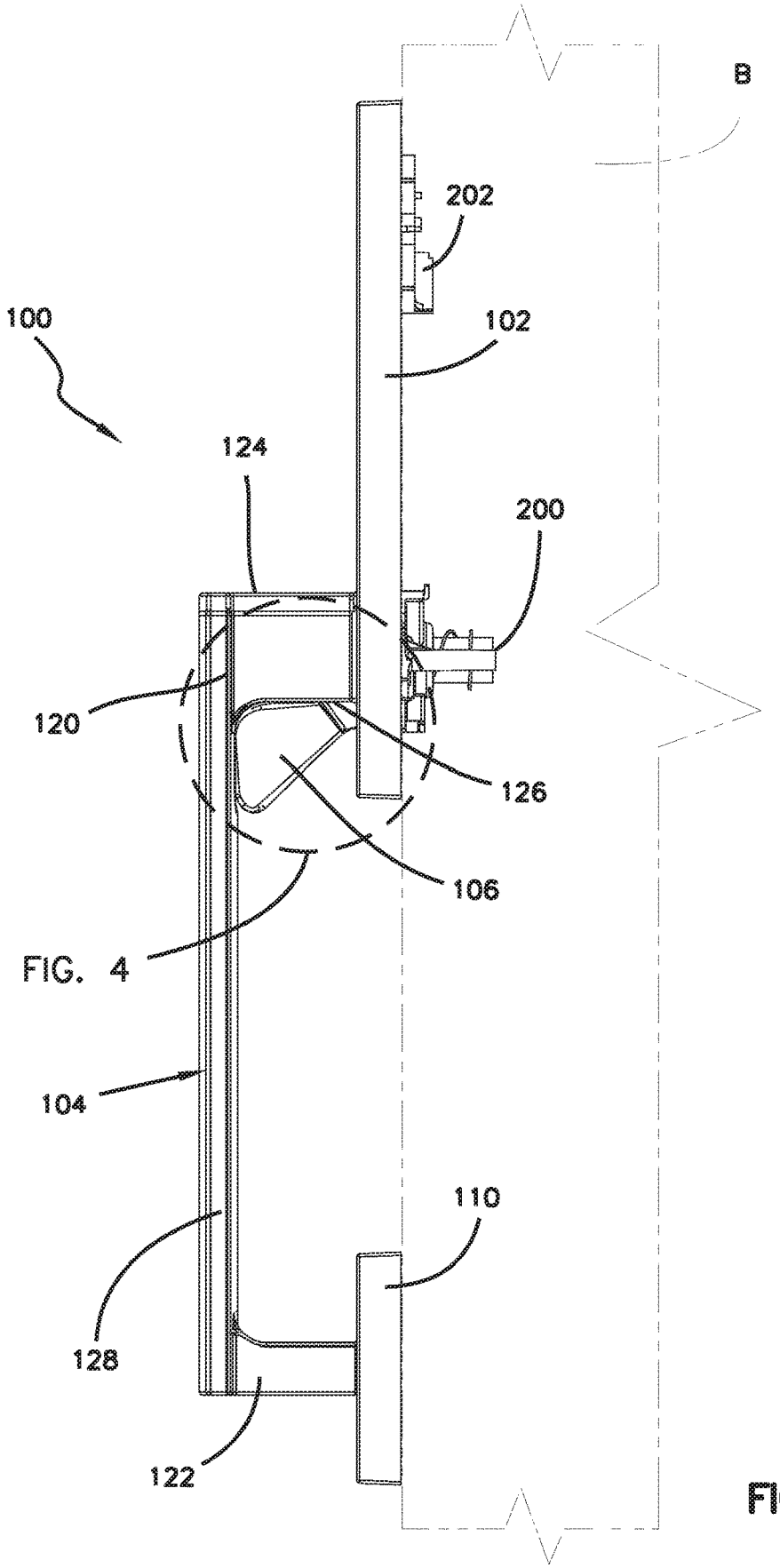
FIG. 3 shows a side view of an exterior portion of the locking assembly mounted on a door of FIG. 1.

FIG. 3 is a side view of the latching handleset assembly 100 mounted on a door B. The latching handleset assembly 100 includes at least an escutcheon 102, a handle 104, and a trigger 106.=The escutcheon 102 and the second escutcheon 110 are attached to the door B, spaced apart from each other.

In the embodiment shown, the top mounting portion 120 and the bottom mounting portion 122 extend from escutcheon 102 and second escutcheon 110 and perpendicular from the door B. The handle portion 128 extends from the top mounting portion 120 to the bottom mounting portion 122 in a direction generally parallel to the door B. The handle portion 128 is connected perpendicularly to the top mounting portion 120 and the bottom mounting portion 122. However, in other embodiments the top mounting portion 120 and the handle portion 128 may have other shapes such as an arc or connecting at an angle other than 90 degrees.

The handle 104 includes the top mounting portion 120 which has a top surface 124 and a bottom 126. The top surface 124 and the bottom 126 oppose each other. The bottom 126 also includes a recess (not shown). The recess is sized and shaped to accept at least a portion of the trigger 106. A handle portion 128 extends down from the top mounting portion 120, such that the bottom 126 is at least partially obscured by the handle portion 128. The trigger 106 is also at least partially obscured by the handle portion 128. As shown, the trigger 106 is located closer to the door B than the handle portion 128, when the latching handleset assembly 100 is installed on the door B.

The trigger 106 is located inferior to the bottom 126 of the top mounting portion 120 and extends into the escutcheon 102. The trigger 106 includes a pivot point (seen below in connection with FIGS. 8-9) that is located within the escutcheon 102. As shown, when the trigger 106 is in the neutral position, it is located along the bottom 126 of the top mounting portion 120.

The escutcheon 102 houses the housing assembly 200. The housing assembly 200 may be located external to the door B, or part of the housing assembly 200 may be located within a portion of the door B. The escutcheon 102 may also house at least part of the deadbolt mechanism 202.

Figure 4:
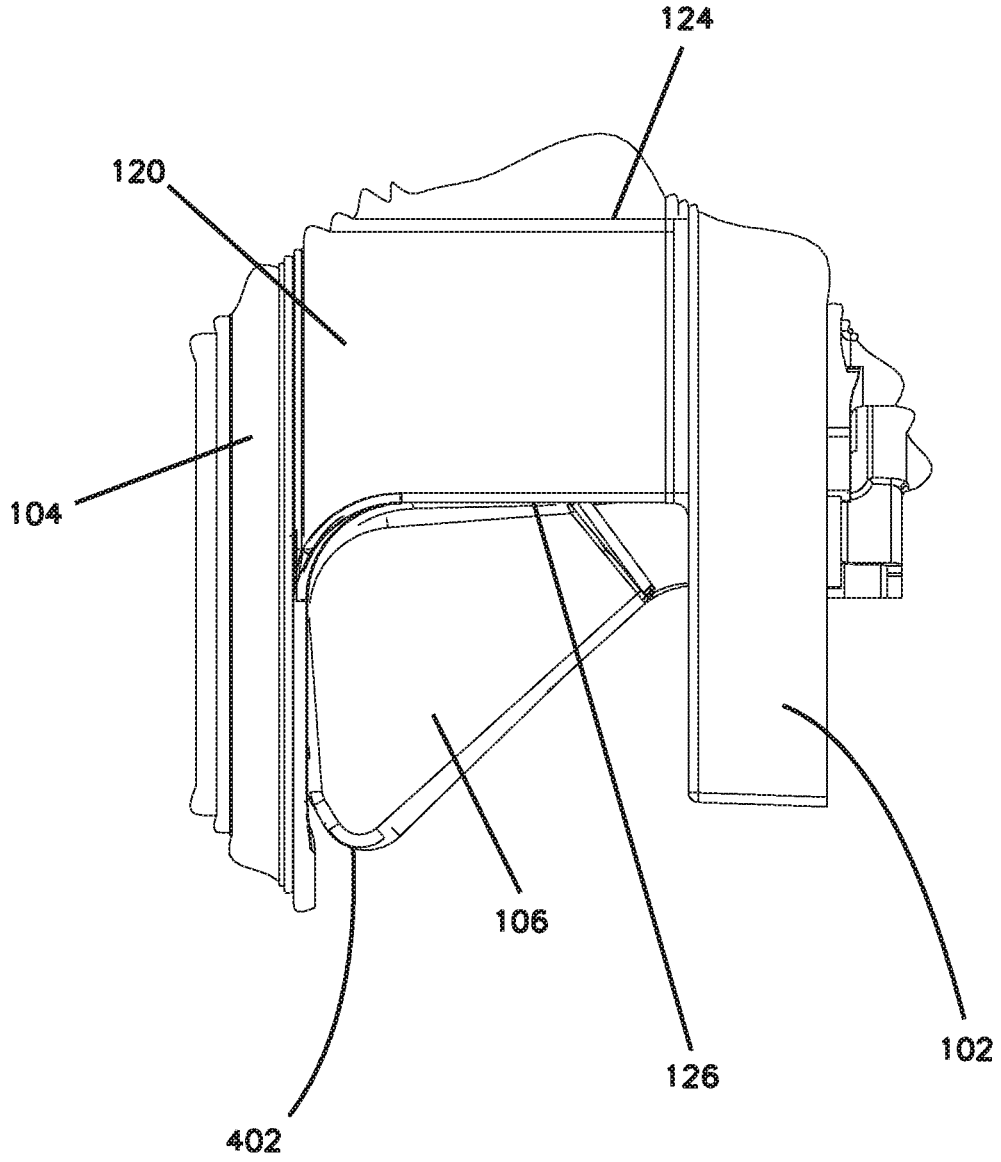
FIG. 4 shows a side view of a trigger of the locking assembly of FIG. 1.

FIG. 4 illustrates another view of the trigger 106 in a neutral position. The neutral position is when the trigger 106 is not actuated by a user. The trigger 106 includes an exterior end 402 and an interior end located within the escutcheon 102. The trigger 106 also includes a pivot point located within the escutcheon 102.

The handle 104 includes the top mounting portion 120 which has a top surface 124 and a bottom 126. The bottom 126 is at least partially obscured by the handle portion 128. The trigger 106 is also at least partially obscured by the handle portion 128. In the embodiment shown, the handle 104 may not include a bottom mounting portion.

Figure 5:
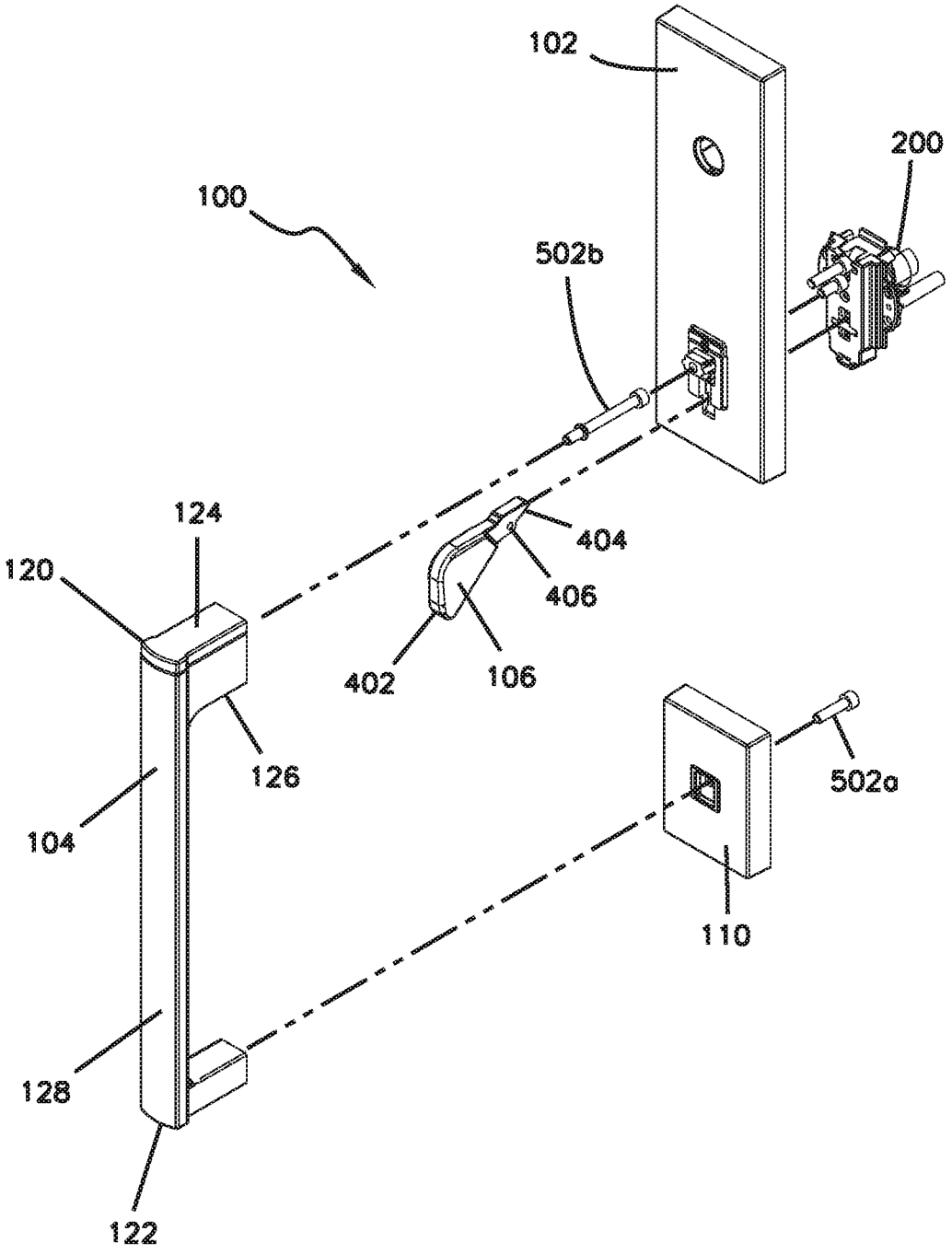
FIG. 5 shows an exploded view of a locking assembly of FIG. 1.

FIG. 5 illustrates an exploded view of the latching handleset assembly 100. The latching handleset assembly 100 includes escutcheon 102 and second escutcheon 110. A handle 104 includes a top mounting portion 120 connected to escutcheon 102 and a bottom mounting portion 122 connected to second escutcheon 110.

The escutcheon 102 conceals the housing assembly 200. The escutcheon 102 may also conceal a deadbolt mechanism (not shown). The escutcheon 102 also includes an attachment mechanism **502*b* to connect to the top mounting portion 120. The second escutcheon 110 includes an attachment mechanism 502*a* to connect to the bottom mounting portion 122**.

The handle 104 as shown includes the top mounting portion 120 and the bottom mounting portion 122, which are connected by a handle portion 128. The top mounting portion 120 includes a top surface 124 and a bottom 126. In an embodiment, the bottom 126 includes a recess (not shown) that allows at least a portion of an exterior end 402 of the trigger 106 to extend when the trigger 106 is in an actuated position.

The trigger 106 includes an exterior end 402 and an interior end 404. The exterior end 402 is located at the bottom 126 of the top mounting portion 120 (e.g., extending at least partially downward from the bottom 126). The interior end 404 extends through escutcheon 102 and is in communication with the housing assembly 200. The trigger 106 is configured to pivot at pivot point 406, which is also located within the escutcheon 102.

As noted above, the trigger 106 is pivotable between a neutral position and an actuated position. When the trigger 106 is pivoted from the neutral position to the actuated position, at least a portion of the exterior end 402 is movable from an exposed position to a recessed position (seen in FIGS. 8-9). When in the recessed position, at least a portion of the exterior end 402 is located within a recess of the top mounting portion 120. When in the exposed position, at least some additional portion of the exterior end 402 is exposed below the bottom 126, since the exterior end 402 will protrude or be spaced further from the bottom 126 in the exposed position (corresponding to the neutral position of the trigger 106).

Figure 6:
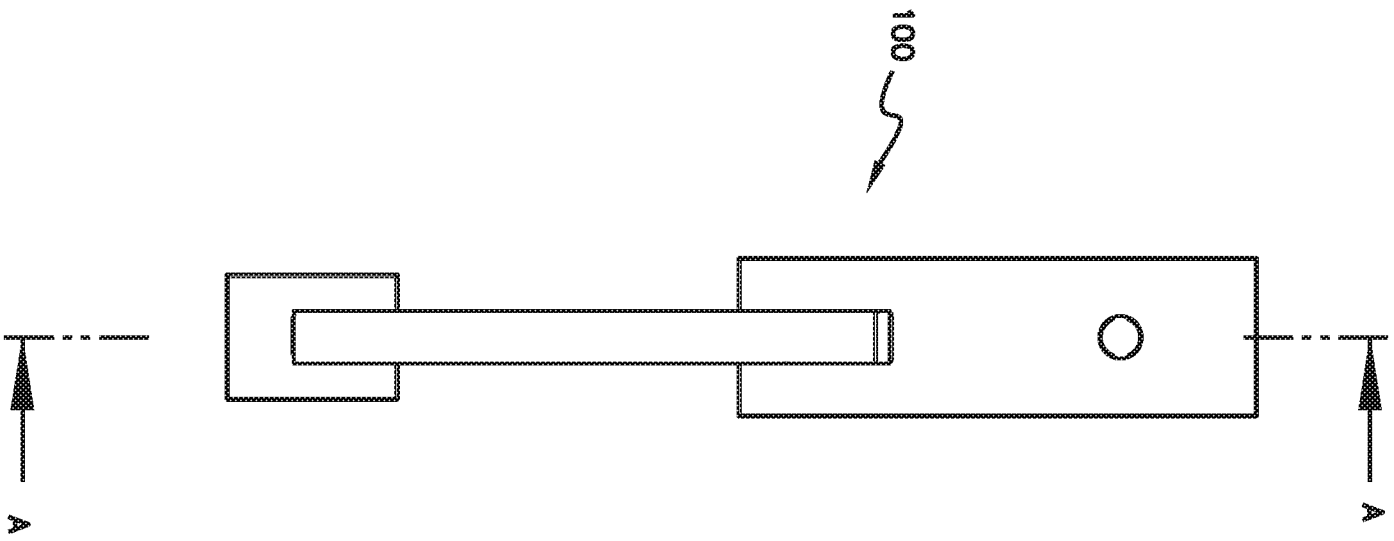
FIG. 6 shows a front view of an exterior portion of the locking assembly of FIG. 1.

FIG. 6 illustrates a front view of the latching handleset assembly 100. Line A is a cross-sectional vertical line through the latching handleset assembly 100. As shown, the latching handleset assembly 100 is symmetrical along line A; however, this is not required. Notably, from the front view of the latching handleset assembly 100, the trigger 106 is obscured from view by the handle 104 (e.g., behind handle portion 128, and below the top mounting portion 120).

Figure 7:
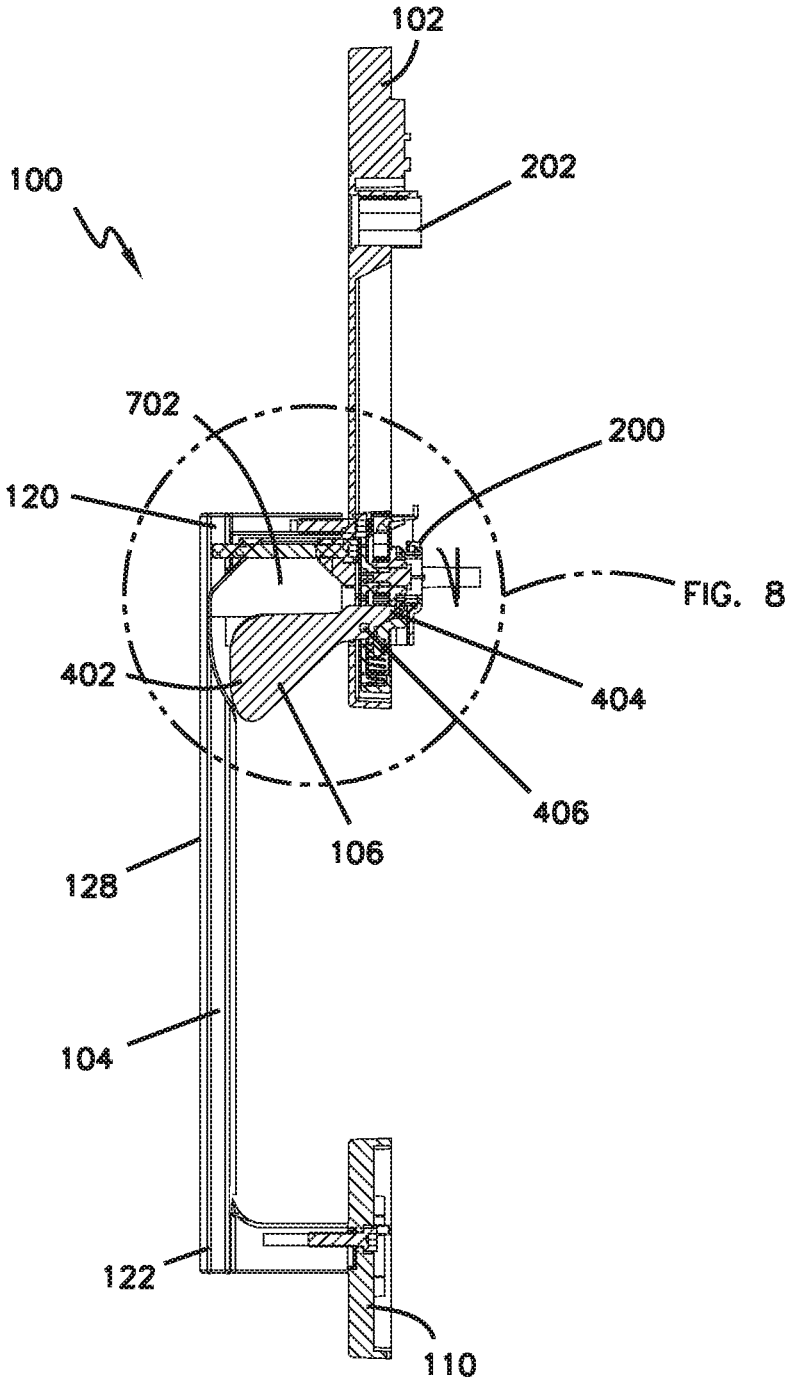
FIG. 7 shows a cross-sectional view of the locking assembly of FIG. 6 along line A.

FIG. 7 illustrates a cross-sectional view of latching handleset assembly 100 along line A of FIG. 6. The latching handleset assembly 100 includes the escutcheon 102 and the second escutcheon 110. The handle 104 extends between the escutcheon 102 and the second escutcheon 110. The handle 104 is connected to the escutcheon 102 at the top mounting portion 120 and connected to the second escutcheon 110 at the bottom mounting portion 122. A handle portion 128 extends between the top mounting portion 120 and the bottom mounting portion 122.

The top mounting portion 120 includes a recess 702, which is shaped to accept an exterior end 402 of the trigger 106 when the trigger 106 is in an actuated position.

The escutcheon 102 houses the housing assembly 200 and the optional deadbolt mechanism 202. The escutcheon 102 also houses the pivot point 406 and at least a portion of the interior end 404 of the trigger 106.

Figure 8:
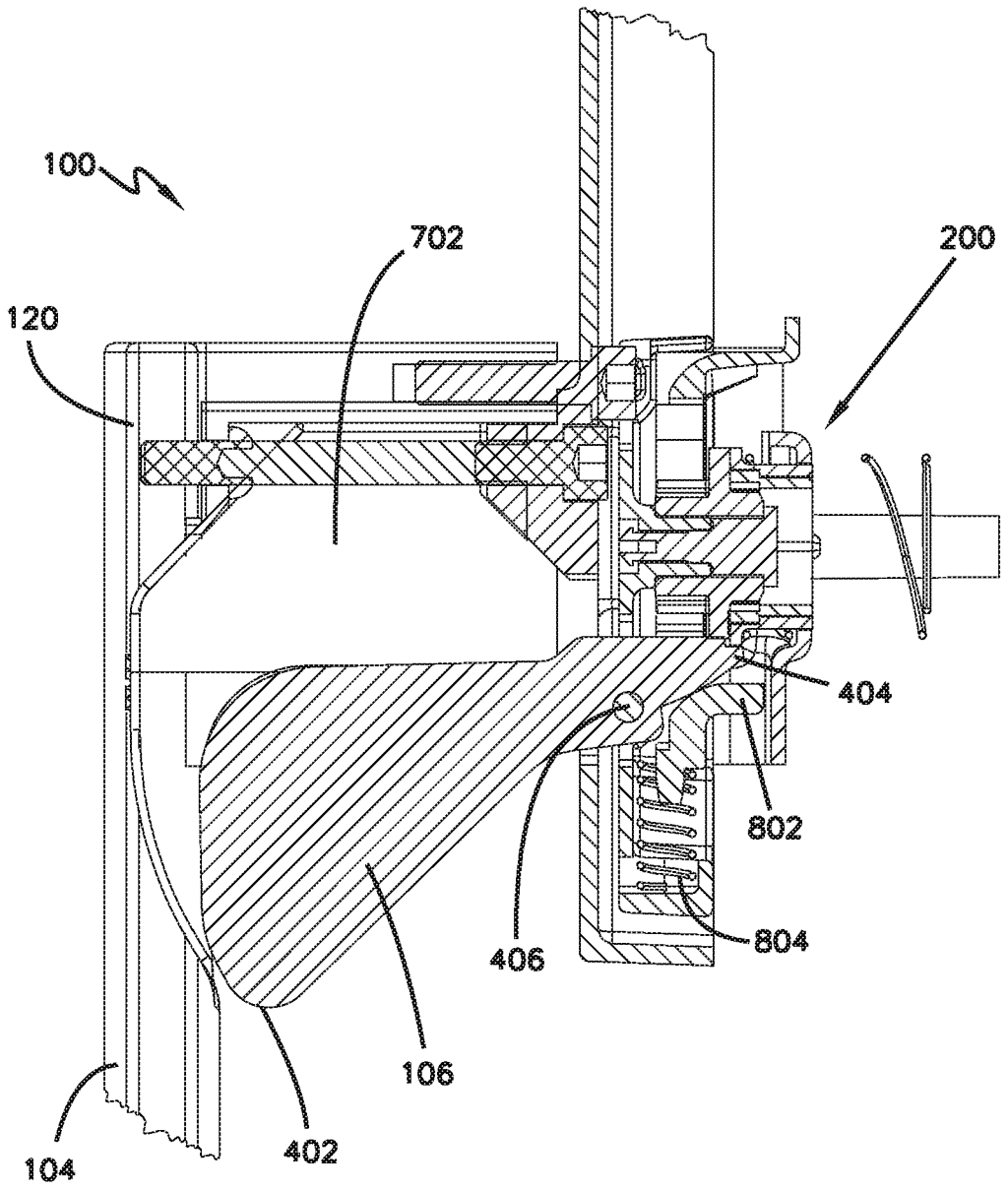
FIG. 8 shows a cross-sectional view of the trigger of FIG. 6 along line A in a neutral position.
Figure 9:
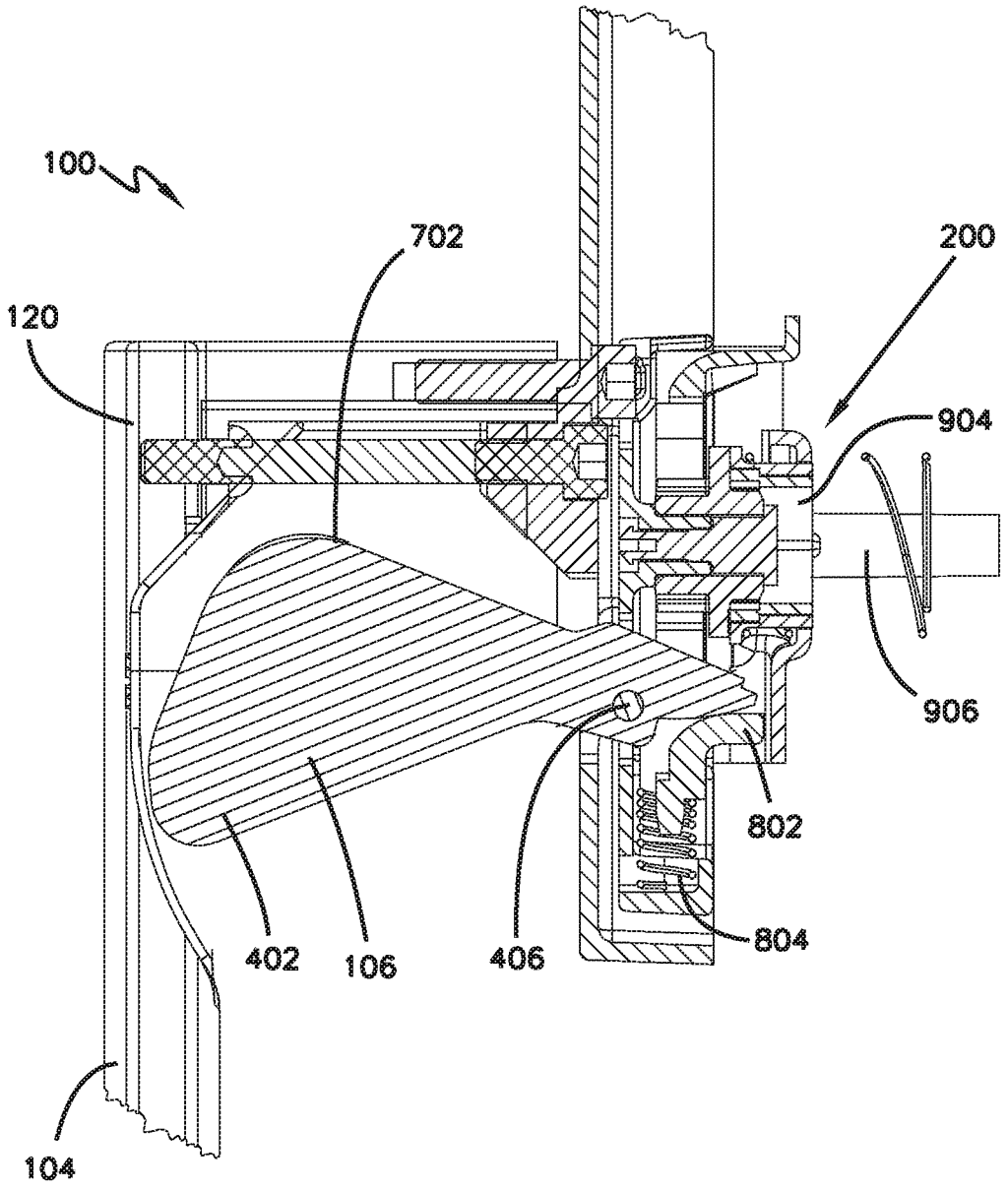
FIG. 9 shows a cross-sectional view of the trigger of FIG. 6 along line A in a latch actuating position.

FIGS. 8-9 illustrate further detailed cross sectional views, along line A, of the latching handleset assembly 100, in neutral and actuated positions. Specifically, FIG. 8 illustrates another cross sectional view, along line A, of the latching handleset assembly 100 in a neutral configuration. In the example shown, latching handleset assembly 100 includes a handle 104, a trigger 106, and the housing assembly 200.

The trigger 106 includes the exterior end 402 located below the bottom 126 of the top mounting portion 120. For example, when installed on a door, the trigger 106 is located inferior to the bottom 126, and closer to the door than the handle portion 128. When the trigger 106 is in a neutral configuration, at least a portion of the exterior end 402 is positioned outside of the recess 702. In some embodiments, in the neutral configuration, the entirety of the exterior end is positioned outside of (below) the recess 702. The trigger 106 pivots about the pivot point 406 in a generally vertical direction when installed on a door.

The housing assembly 200 includes a compression bracket 802 that is in communication with the interior end 404 and a spring 804. When installed on a door, the interior end 404 is located above the compression bracket 802, which is located above the spring 804. The housing assembly 200 also includes a pinion 904 that is in communication with a latch driver 906. In an installed configuration, the pinion 904 and the latch driver 906 rotate around a longitudinal axis, which is perpendicular to the door.

In a neutral configuration, the spring 804 is not compressed, and maintains the compression bracket 802 in an uncompressed configuration. For example, when installed, in the uncompressed configuration, the latch driver 906 maintains a latch bolt in the neutral position. When installed on a door, in the neutral configuration, the compression bracket 802 is not providing a downward force on the spring 804. The compression bracket 802 maintains an upward force on the interior end 404 of the trigger, and the exterior end 402 is not located within the recess 702.

FIG. 9 illustrates a cross-sectional view of the latching handleset assembly 100 including a handle 104, a trigger 106, and the housing assembly 200 in a latch actuating position.

In the latch actuating position, the exterior end 402 of the trigger 106 is moved into the recess 702 of the top mounting portion 120 (e.g., by user action). This causes the trigger 106 to pivot at pivot point 406, and the interior end 404 is engaged with compression bracket 802. Generally, the pivoting motion is in a direction substantially parallel to a door on which the latching handleset assembly 100 is mounted (in this case, a generally upwards motion).

The housing assembly 200 includes at least the compression bracket 802, the spring 804, and the latch driver 906. When compression bracket 802 is actuated, the spring 804 is compressed, which causes the latch driver 906 to move from the neutral position to a latch actuating position. The latch driver 906 rotates a latch bolt, which allows the door to be opened.

When the latching handleset assembly 100 is installed on a door, the movement of the compression bracket 802 is parallel to the door. The vertical movement of the compression bracket 802 causes rotational movement of the circular pinion 904 about a horizontal axis. The latch driver 906 also moves in a circular direction around the horizontal axis.

Figure 10:
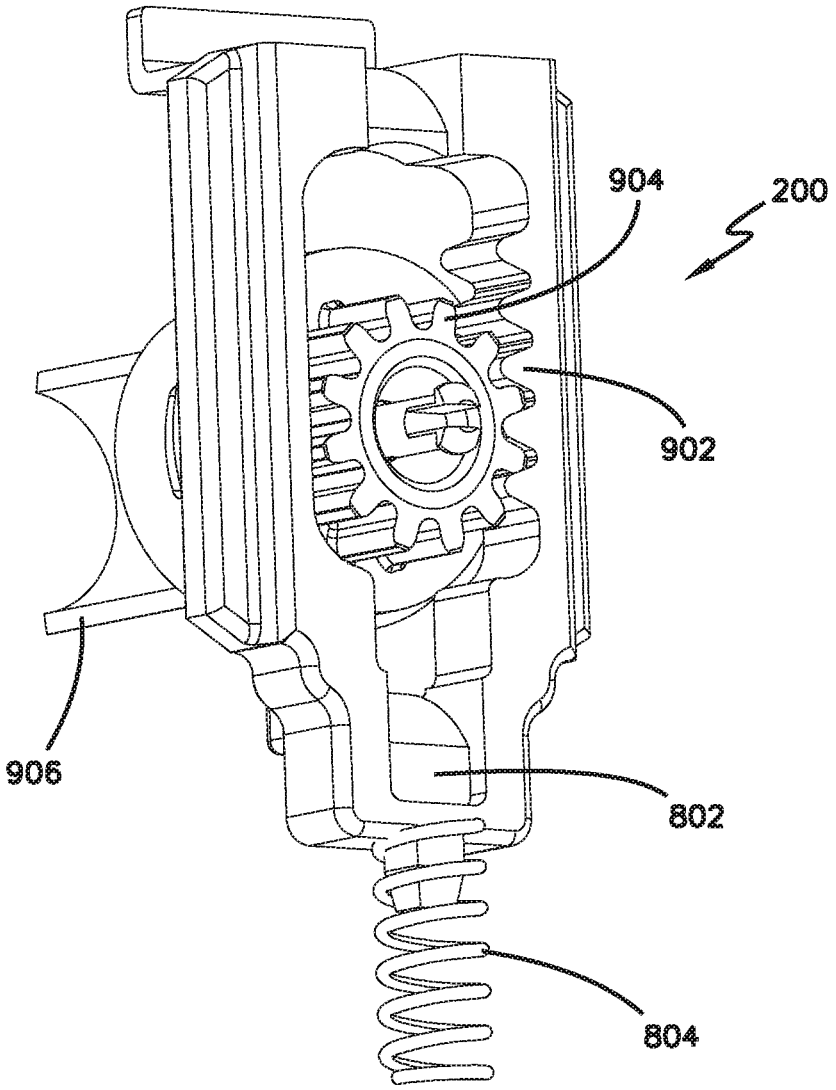
FIG. 10 shows another internal view of a housing assembly in accordance with the present disclosure.

FIG. 10 illustrates an example embodiment of the housing assembly 200. The housing assembly 200 includes a compression bracket 802, a spring 804, and a circular pinion 904. The compression bracket 802 includes a plurality of teeth 902 that are engageable with the circular pinion 904. When the compression bracket 802 is actuated by the trigger 106, the compression bracket 802 moves in a linear direction, which causes the circular pinion 904 to rotate along a first axis. The first axis is normal to the linear directional movement of the compression bracket 802. The circular pinion 904 is connected to the latch driver 906. When the circular pinion 904 rotates, it causes the latch driver 906 to also rotate. The latch driver 906 rotates a latch bolt, which allows the door to be opened.

When the trigger 106 is released the spring 804 provides a force on the compression bracket 802, which causes the compression bracket 802 to move in an opposing linear direction. This causes the circular pinion 904 to rotate along the first axis in an opposing direction, which also causes the latch driver 906 to rotate along the first axis in the opposing direction.

Figure 11:
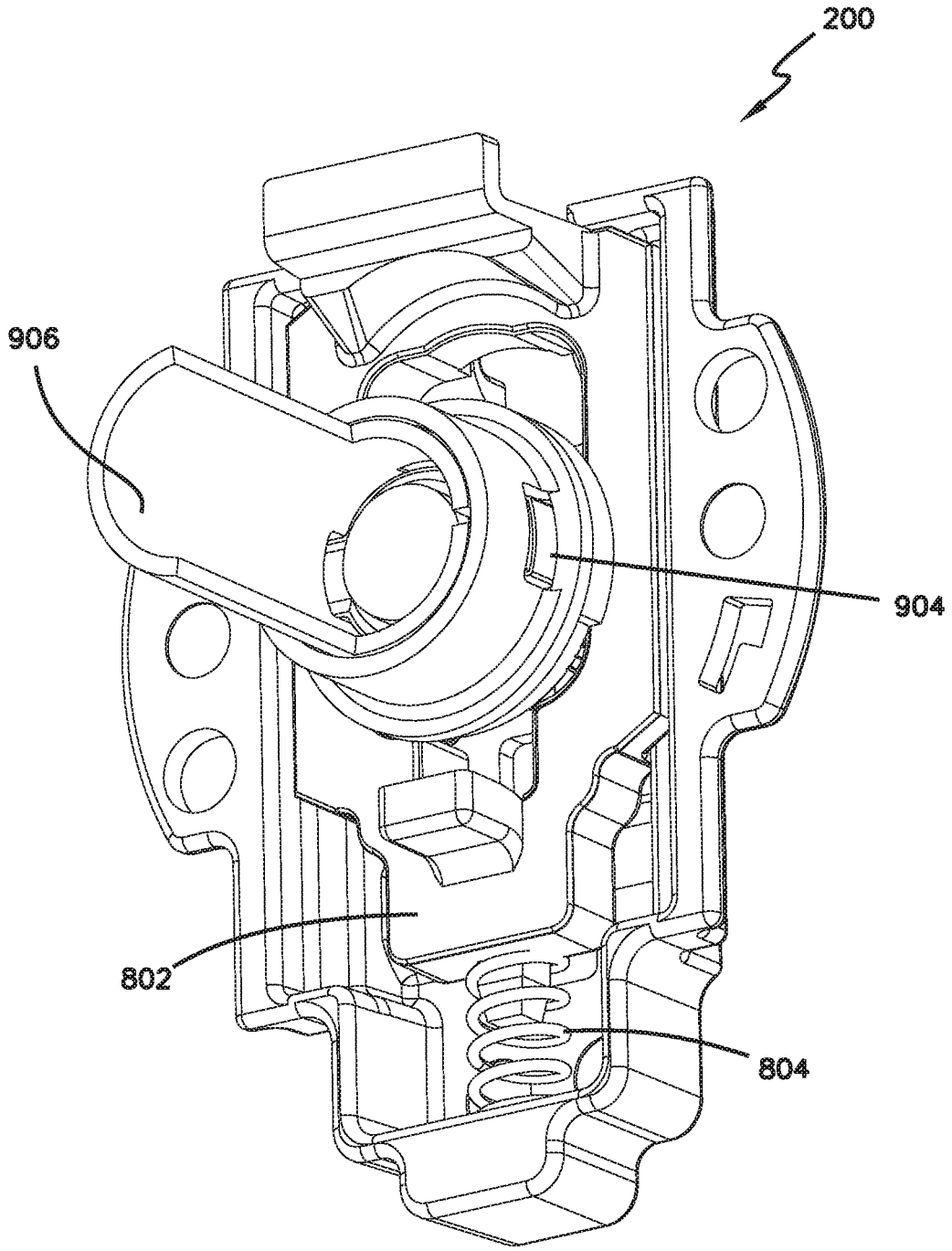
FIG. 11 shows another internal view of the housing assembly.

FIG. 11 illustrates an alternative view of the housing assembly 200. The housing assembly 200 includes the latch driver 906, which is connected to the circular pinion 904. The circular pinion 904 causes the latch driver 906 to rotate along the first axis, which moves a latch bolt between extended and retracted positions, as discussed above.

In use, the latching handleset assembly 100 is mounted on a door. A user actuates a trigger 106, which allows the user to open the door. When the user is not applying force to the trigger, the latch bolt moves back to a neutral position, which maintains the door in a closed position.

EXAMPLES

Illustrative examples of the latching handleset disclosed herein are provided below. An embodiment of the latching handleset may include any one or more, and any combination of, the examples described below.

In Example 1, a latching handleset assembly is described. The latching handleset assembly includes a handle, a trigger, and a latch driver. The handle has a handle portion and a top mounting portion that extends from an escutcheon. The top mounting portion has a top surface and a bottom that is at least partially obscured by the handle portion. The trigger includes an exterior end located along the bottom of the top mounting portion and an interior end that extends into the escutcheon. The trigger is pivotable about a pivot point positioned within the escutcheon. The latch driver is movable between a neutral position and a latch actuating position in response to actuation of the trigger.

In Example 2, the latching handleset assembly of any of the examples disclosed herein, is modified in that the trigger is pivotable between a neutral position and an actuated position, such that when the trigger is pivoted from the neutral position to the actuated position, at least a portion of the exterior end is movable from an exposed position to a recessed position within the top mounting portion.

In Example 3, the latching handleset assembly of any of the examples disclosed herein, is modified to include a bracket biased into a neutral position by a spring, the bracket movable from the neutral position to an actuated position in response to actuation of the trigger, the bracket including a rack. The latch driver includes a geared end operatively engaged with the rack to move the latch driver between the neutral position and the latch actuating position.

In Example 4, the latching handleset assembly of any of the examples disclosed herein, is modified to include a bolt movable between an extended position and a retracted position in response to actuation of the trigger.

In Example 5, the latching handleset assembly of any of the examples disclosed herein, is modified in that the bracket resides at least in part within the escutcheon.

In Example 6, the latching handleset of any of the examples disclosed herein, is modified in that a direction of movement of the bracket between the neutral position and the actuated position is perpendicular to a direction of movement of the bolt between the extended position and the retracted position.

In Example 7, the latching handleset assembly of any of the examples disclosed herein, is modified in that movement of the bracket from the neutral position to the actuated position compresses the spring.

In Example 8, the latching handleset assembly of any of the examples disclosed herein, is modified in that the handle further includes a bottom mounting portion extending from the handle portion to a secondary escutcheon.

In Example 9, the latching handleset assembly of any of the examples disclosed herein, is modified to include a locking cylinder extending through the escutcheon.

In Example 10, the latching handleset assembly of any of the examples disclosed herein, is modified in that the spring biases the bracket toward the neutral position such that, upon release of the trigger, the bracket returns to the neutral position and the trigger moves from the actuated position to the neutral position.

In Example 11, a method for operating a latching handleset assembly is described. The latching handleset assembly includes a top mounting portion, a handle portion, and a trigger at least partially obscured by the handle portion. The method including actuating an exterior end of the trigger, which causes the trigger to pivot about a pivot point positioned within an escutcheon. Pivoting the trigger causes an interior end of the trigger located within the escutcheon to actuate a latch driver. Actuating the latch driver causes the latch driver to move between a neutral position and a latch actuating position.

In Example 12, the method of any of the examples disclosed herein, is modified in that when the trigger is pivoted from a neutral position to an actuated position, at least a portion of the exterior end of the trigger is movable from an exposed position to a recessed position within the top mounting portion.

In Example 13, the method of any of the examples disclosed herein, is modified in that in response to actuation of the trigger, a bracket biased by a spring moves from a neutral position to an actuated position, and the latch driver, including a geared end operatively engaged with a rack, causes the latch driver to move between the neutral position and the latch actuating position.

In Example 14, the method of any of the examples disclosed herein, is modified in that in response to actuation of the trigger, a latch bolt is movable between an extended position and a retracted position.

In Example 15, the method of any of the examples disclosed herein, is modified in that a direction of movement of the bracket between the neutral position and the actuated position is perpendicular to a direction of movement of the latch bolt between the extended position and the retracted position.

In Example 16, the method of any of the examples disclosed herein, is modified in that when the bracket moves from the neutral position to the actuated position, the spring is compressed.

In Example 17, a latching handleset assembly is described. The latching handleset assembly includes a handle, a trigger, a latch driver, and a latch assembly. The handle has a vertical handle portion and a top mounting portion that extends in a horizontal direction from an escutcheon mounted on a door. The top mounting portion has a top surface and a bottom that is at least partially obscured by the handle portion. The trigger includes an exterior end located along the bottom of the top mounting portion and an interior end that extends into the escutcheon. The trigger is pivotable about a pivot point positioned within the escutcheon. The latch driver is movable between a neutral position and a latch actuating position in response to actuation of the trigger. The latch assembly includes a latch bolt movable between an extended position and a retracted position in response to actuation of the trigger.

In Example 18, the latching handleset assembly of any of the examples disclosed herein, is modified in that the trigger is pivotable between a neutral position and an actuated position, such that when the trigger is pivoted from the neutral position to the actuated position, at least a portion of the exterior end is movable from an exposed position to a recessed position within the top mounting portion.

In Example 19, the latching handleset assembly of any of the examples disclosed herein, is modified to include a housing assembly. The housing assembly includes a bracket biased into a neutral position by a spring. The bracket is movable from the neutral position to an actuated position in response to actuation of the trigger. The bracket includes a rack. The latch driver includes a geared end operatively engaged with the rack to move the latch driver between the neutral position and the latch actuating position.

In Example 19, the latching handleset assembly of any of the examples disclosed herein, is modified in that a direction of movement of the bracket between the neutral position and the actuated position is perpendicular to a direction of movement of the latch bolt between the extended position and the retracted position.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

The invention claimed is:

1. A latching handleset assembly comprising:

a handle having a handle portion and a top mounting portion extending from an escutcheon, the top mounting portion having a top surface and a bottom with a recess at least partially obscured by the handle portion;

a trigger comprising an exterior end located along the bottom of the top mounting portion proximate the recess, the exterior end at least partially exposed relative to the top mounting portion, and an interior end extending into the escutcheon, the trigger being pivotable about a pivot point positioned within the escutcheon, wherein the exterior end is positioned opposite of the interior end relative to the pivot point;

a housing assembly including a bracket biased into a neutral position by a spring, the interior end of the trigger engaged with the bracket; and a latch driver movable between a neutral position and a latch actuating position in response to actuation of the trigger.

2. The latching handleset assembly of claim 1, wherein the trigger is pivotable between a neutral position and an actuated position, such that when the trigger is pivoted from the neutral position to the actuated position, at least a portion of the exterior end is movable from an exposed position to a recessed position within the top mounting portion.

3. The latching handleset assembly of claim 1, wherein the bracket is movable from the neutral position to an actuated position in response to actuation of the trigger, the bracket including a rack; and wherein the latch driver includes a geared end operatively engaged with the rack to move the latch driver between the neutral position and the latch actuating position.

4. The latching handleset assembly of claim 3, further comprising a latch assembly including a bolt movable between an extended position and a retracted position in response to actuation of the trigger.

5. The latching handleset assembly of claim 4, wherein a direction of movement of the bracket between the neutral position and the actuated position is perpendicular to a direction of movement of the bolt between the extended position and the retracted position.

6. The latching handleset assembly of claim 3, wherein the bracket resides at least in part within the escutcheon.

7. The latching handleset assembly of claim 3, wherein movement of the bracket from the neutral position to the actuated position compresses the spring.

8. The latching handleset assembly of claim 3, wherein the spring biases the bracket toward the neutral position such that, upon release of the trigger, the bracket returns to the neutral position and the trigger moves from an actuated position to a neutral position.

9. The latching handleset assembly of claim 1, wherein the handle further includes a bottom mounting portion extending from the handle portion to a secondary escutcheon.

10. The latching handleset assembly of claim 1, further comprising a locking cylinder extending through the escutcheon.

11. A method for operating a latching handleset assembly having a top mounting portion, a handle portion, and a trigger at least partially obscured by the handle portion, the method comprising:

actuating an exterior end of the trigger, causing the trigger to pivot about a pivot point positioned within an escutcheon, the exterior end at least partially exposed relative to the top mounting portion;

wherein:

pivoting the trigger causes an interior end of the trigger located within the escutcheon to engage a bracket within a housing assembly biased into a neutral position by a spring so as to actuate a latch driver, the exterior end is positioned opposite of the interior end relative to the pivot point; and actuating the latch driver causes the latch driver to move between a neutral position and a latch actuating position.

12. The method of claim 11, wherein when the trigger is pivoted from a neutral position to an actuated position, at least a portion of the exterior end of the trigger is movable from an exposed position to a recessed position within the top mounting portion.

13. The method of claim 11, wherein in response to actuation of the trigger, the bracket biased by the spring moves from the neutral position to an actuated position, and the latch driver including a geared end operatively engaged with a rack causes the latch driver to move between the neutral position and the latch actuating position.

14. The method of claim 13, wherein in response to actuation of the trigger, a latch bolt is movable between an extended position and a retracted position.

15. The method of claim 14, wherein a direction of movement of the bracket between the neutral position and the actuated position is perpendicular to a direction of movement of the latch bolt between the extended position and the retracted position.

16. The method of claim 13, wherein when the bracket moves from the neutral position to the actuated position, the spring is compressed.

17. A latching handleset assembly comprising:

a handle having a vertical handle portion and a top mounting portion extending in a horizontal direction from an escutcheon mounted on a door, the top mounting portion having a top surface and a bottom with a recess at least partially obscured by the handle portion;

a trigger having an exterior end located along the bottom of the top mounting portion proximate the recess, the exterior end at least partially exposed relative to the top mounting portion, and an interior end extending into the escutcheon, the trigger being pivotable about a pivot point positioned within the escutcheon, wherein the exterior end is positioned opposite of the interior end relative to the pivot point;

a housing assembly including a bracket biased into a neutral position by a spring, the interior end of the trigger engaged with the bracket;

a latch driver movable between a neutral position and a latch actuating position in response to actuation of the trigger; and a latch assembly including a latch bolt movable between an extended position and a retracted position in response to actuation of the trigger.

18. The latching handleset assembly of claim 17, wherein the trigger is pivotable between a neutral position and an actuated position, such that when the trigger is pivoted from the neutral position to the actuated position, at least a portion of the exterior end is movable from an exposed position to a recessed position within the top mounting portion.

19. The latching handleset assembly of claim 17, wherein the bracket is movable from the neutral position to an actuated position in response to actuation of the trigger, the bracket including a rack; and wherein the latch driver includes a geared end operatively engaged with the rack to move the latch driver between the neutral position and the latch actuating position.

20. The latching handleset assembly of claim 19, wherein a direction of movement of the bracket between the neutral position and the actuated position is perpendicular to a direction of movement of the latch bolt between the extended position and the retracted position.

* * * * *